US005785318A

United States Patent [19]

Nesis

[11] Patent Number: 5,785,318

[45] Date of Patent: Jul. 28, 1998

[54] AMUSEMENT DEVICE OF SHIFTING BLOCK TYPE

[76] Inventor: Dov Nesis, 4 Efter Street, Apt 12, Tel-Aviv 69362, Israel

[21] Appl. No.: 877,664

[22] Filed: Jun. 18, 1997

[51] Int. Cl.[6] ..... A63F 9/08

[52] U.S. Cl. ..... 273/153 S; 446/331

[58] Field of Search ..... 273/153 R, 153 S, 273/157 R; 446/330, 331, 376, 377

[56] References Cited

U.S. PATENT DOCUMENTS

| | | | |
|---|---|---|---|
| 332,211 | 12/1885 | Protheroe . | |
| 442,445 | 12/1890 | Lurtey . | |
| 639,602 | 12/1899 | McGenniss . | |
| 814,653 | 3/1906 | Healey . | |
| 1,101,567 | 6/1914 | Ridgway . | |
| 2,500,263 | 3/1950 | Pascoo . | |
| 2,682,119 | 6/1954 | Rutz . | |
| 2,948,535 | 8/1960 | Ellman | 273/153 S |
| 2,979,834 | 4/1961 | Giles . | |
| 3,693,291 | 9/1972 | Aoki . | |
| 3,767,202 | 10/1973 | Sternad | 273/153 S |
| 4,269,414 | 5/1981 | DeVus | 273/153 S |
| 4,412,681 | 11/1983 | Irwin | 273/153 S |
| 4,422,641 | 12/1983 | Collin | 273/153 S |
| 4,513,970 | 4/1985 | Opresco | 273/153 S |
| 4,548,410 | 10/1985 | Morrone | 273/153 S |
| 5,074,561 | 12/1991 | Johnson | 273/153 S |
| 5,267,732 | 12/1993 | Bowen | 273/153 S |
| 5,529,301 | 6/1996 | Feller | 273/153 S |

*Primary Examiner*—Steven B. Wong
*Attorney, Agent, or Firm*—Robert W. J. Usher

[57] ABSTRACT

A hand-held puzzle comprising an planar, square array of mirror surface tiles confined for sequential planar movement via a ninth, vacant, tile size space or to alter the positions of individual blocks in the array. A humanoid character molded in one piece from elastomeric material has hands and feet anchored to preselected respective corner tiles by adhesive so that the limbs torso can be twisted, intertwined and contorted into stable different configurations by such sequential movement of respective tiles. The character's body is marked with black and white stripes which extend in straight manner along the limbs and torso when the body is undeformed enabling the direction of distortion of the limbs body to be more readily perceived by a player.

12 Claims, 1 Drawing Sheet

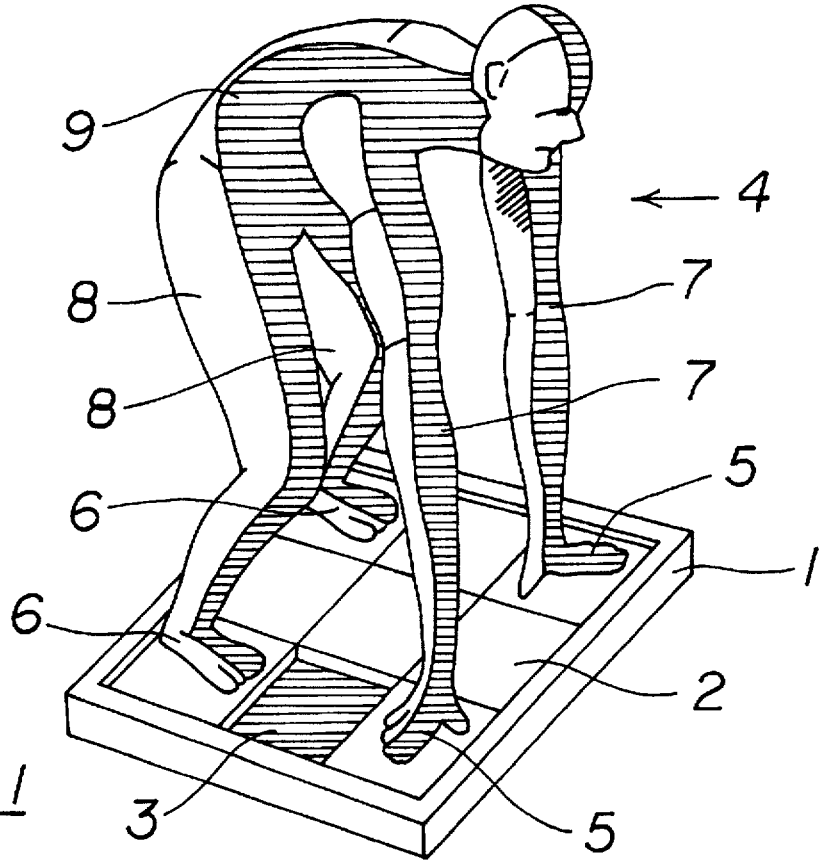
FIG 1
FIG 2
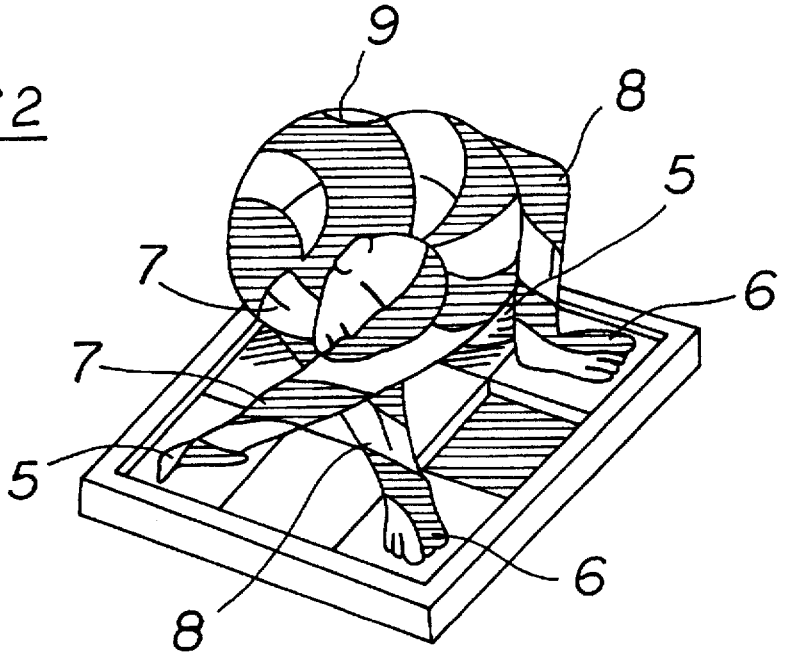

AMUSEMENT DEVICE OF SHIFTING BLOCK TYPE

FIELD OF THE INVENTION

The invention relates to an amusement device of a shifting block type.

BACKGROUND OF THE INVENTION

Amusement devices of the shifting block type have been in widespread use for more than one hundred years more than fifty years. In one form of such puzzles, a series of tiles are confined in a generally two dimensional array by a frame so as to permit sequential lateral coplanar movement of selected individual tiles within the frame to change the array typically to reorder a sequence of numbers or letters marked on the exposed surface of the tiles or to change a pattern or picture depicted by the tiles.

Examples of the very numerous puzzles of the type described above are taught by U.S. Pat. No. 1,101,567 issued to Ridgway in 1914; 4,422,641 issued to Collin in 1983; 4,548,410 issued to Morrone in 1985 and 5,267,723 issued to Bowen in 1993, the disclosures of which are incorporated herein by reference.

SUMMARY OF THE INVENTION

It is an object of the invention to utilizes the two dimensional movement to change the shape of a three dimensional object upstanding from the tiles thereby providing an entirely new and amusing visual effect or a puzzle of increased complexity.

According to one aspect of the invention, in amusement device of a shifting block type in which a series of blocks are confined in a two dimensional array on a base for sequential coplanar movement of selected individual tiles to different stable positions to change the array, the improvement comprises a body supported upstanding from the blocks by flexible appendages having respective free ends anchored to predetermined respective blocks for movement therewith reversibly to one of alter positions, twist and intertwine the appendages.

A player solves the puzzle by moving the blocks sequentially to untwist, twist, intertwine or unravel the appendages to obtain a selected body shape or position.

The body may be a recognizable animal character such as a humanoid having limbs, such as arms and legs which form the appendages.

Instructions can be provided with the device to release a twisted or contorted character from the bondage of a deformed state.

The free ends of the limbs can be anchored to the tiles by releasable anchoring means to permit release thereof from respective tiles to permit unrestricted movement of the body to restore the body to a former shape, when the puzzle cannot be solved by a player.

Desirably, the body is molded in one piece from an elastomeric material.

BRIEF DESCRIPTION OF THE DRAWINGS

A specific embodiment of the invention will now be described with reference to the accompanying drawings wherein:

FIG. 1 is a perspective view of a puzzle with a humanoid character thereof in an undeformed position, according to the invention, and FIG. 2 is a non- rigorous, schematic perspective view showing the humanoid character in a deformed position following tile movement.

DESCRIPTION OF PARTICULAR EMBODIMENT

The amusement device is a hand-held puzzle comprising a square, base frame 1 with a back panel confining eight square, mirror surface, tiles 2 in planar, two- dimensional array, linked in known manner by interfitting tongues and grooves for sequential movement via a ninth, vacant, tile size space or recess 3 to alter the positions of individual tiles in the array (and/or the position of the space 3), as known in sequential movement puzzles of the linked sliding block type.

As shown particularly in FIG. 1, a recognizable humanoid character 4 is molded in one piece from elastomeric material and has hands and feet 5 and 6, respectively, anchored to preselected respective corner tiles 2 by adhesive so that the limbs 7 and 8 and torso 9 can be twisted, intertwined and contorted into stable different configurations by such sequential movement of respective tiles 2, as shown, for example, in FIG. 2. The character's body is marked with black and white stripes which extend in straight manner along the limbs and torso when the body is undeformed, as shown in FIG. 1, enabling the direction of distortion of the body (direction of twist etc) to be more readily perceived by the player, a general impression or effect being illustrated schematically, in non-rigorous fashion, in FIG. 2.

In one mode of play, the player is presented with the puzzle in the position shown in FIG. 2 and instructed to move the tiles to untwist and unravel the limbs to return the character 4 to the undeformed state, shown in FIG. 1.

The instructions may describe a theme in which the humanoid character is begging to be released from the contorted position in which he has been shackled by "mad scientists", "tormentors" or "torturers", (e.g returned from the position of FIG. 2 to that of FIG. 1).

In another example, the character's hands and feet are releasably anchored to respective tiles by a clamping screw/washer assembly passing through respective hands and feet into threaded receipt in respective tiles to permit release of the limbs and the tiles to be returned to corner positions if the player perceives the limbs to have become inextricably entwined or that the puzzle cannot be solved.

In an alternative construction, tiles need not be mechanically linked together and may be retained in coplanar relation for example by magnetic means.

The amusement device may provide an ornamental figurine or other object, the shape of which is alterable by tile movement and the different colors selected to enhance any particular aesthetic appeal.

The body may have many different forms such as an insect, human, nude, tree or any animal. The provision of the mirror surface may both improve the ornamental effect and provide an aid in visually determining the directions and extent of body distortion facilitating solving the puzzle.

I claim:

1. An amusement device of a shifting block type comprising a base in which a series of blocks are confined in a two dimensional array for sequential movement of selected individual blocks to different stable positions to change the array, the improvement comprising a body including flexible appendages having respective free ends anchored to predetermined respective blocks thereby supporting the body upstanding from the blocks for movement therewith reversibly to one of alter positions of, twist and intertwine appendages.

2. An amusement device according to claim 1, wherein the body is one of a recognizable animal character having limbs which form at least some of the appendages.

3. An amusement device according to claim 2, wherein the character is a humanoid and the limbs are arms and legs.

4. An amusement device according to claim 2, wherein the free ends of the limbs are anchored to the respective tiles by adhesive.

5. An amusement device according to claim 1, wherein the body is molded in one piece from an elastomeric material.

6. An amusement device according to claim 4, wherein the body is molded in one piece from an elastomeric material.

7. An amusement device according to claim 1, wherein the body has different locations marked with contrasting colors for enabling distortion of the body by block movement to be more readily perceived.

8. An amusement device according to claim 6, wherein the body has different locations marked with contrasting colors for enabling a degree of distortion of the body by block movement to be more readily perceived.

9. An amusement device according to claim 1, wherein the blocks have exposed mirror surfaces.

10. An amusement device according to claim 7, wherein the blocks have exposed mirror surfaces.

11. An amusement device according to claim 7, wherein the contrasting colors are applied to obtain a striped effect.

12. An amusement device according to claim 8, wherein the contrasting colors are applied to obtain a striped effect.

* * * * *